US006582050B2

(12) United States Patent
Akiyama

(10) Patent No.: US 6,582,050 B2
(45) Date of Patent: Jun. 24, 2003

(54) INK JET PRINTING APPARATUS, CALIBRATION METHOD AND CALIBRATION CHART PRINTING METHOD

(75) Inventor: Yuji Akiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/084,169

(22) Filed: Feb. 28, 2002

(65) Prior Publication Data

US 2002/0126172 A1 Sep. 12, 2002

(30) Foreign Application Priority Data

Feb. 28, 2001 (JP) ..... 2001/055563
Feb. 26, 2002 (JP) ..... 2001/050389

(51) Int. Cl.[7] ..... B41J 2/01
(52) U.S. Cl. ..... 347/19
(58) Field of Search ..... 347/15, 19, 43; 400/74; 358/504, 406

(56) References Cited

U.S. PATENT DOCUMENTS 6,474,768 B1 * 11/2002 Yano et al. ..... 347/19
6,494,557 B1 * 12/2002 Kato et al. ..... 347/19

* cited by examiner

*Primary Examiner*—Craig Hallacher
(74) *Attorney, Agent, or Firm*—Fitzpatrick, Cella, Harper & Scinto

(57) ABSTRACT

In addition to the patches to be measured, a pattern of strips, one of which is formed by a combination of cyan and magenta and the other by a combination of yellow and black, is printed prior to the printing of the patches. The band patterns are printed by setting each of the component colors at the same gray scale value as the maximum value of the measurement patches for each color. Thus, in the printing of each band pattern, ink is ejected at two times the duty of the patch with the maximum gray scale value, thereby eliminating the viscous ink almost completely.

26 Claims, 10 Drawing Sheets

INK JET PRINTING APPARATUS, CALIBRATION METHOD AND CALIBRATION CHART PRINTING METHOD

This application is based on Japanese Patent Application Nos. 2001-055563 filed Feb. 28, 2001 and 2002-050389 filed Feb. 26, 2002, the contents of which are incorporated hereinto by reference.

BACKGROUND OF THE INVENTION

1. Field of the Invention

The present invention relates to an ink jet printing apparatus, a calibration method and a calibration chart printing method, and more specifically to a chart that is printed for a calibration which makes a printing characteristic of an ink jet printing apparatus predetermined one.

2. Description of the Related Art

In a printing apparatus widely used for printing characters and images, density and a hue of printed images may change depending on a variation in a condition of an environment, in which the printing apparatus is used to operate, such as temperature and humidity, and on a difference in characteristics of printing materials such as ink and of printing medium such as printing papers. The density of the printed image may also vary from one apparatus to another. Further, these characteristic variations and differences also may be caused by ageing of parts from which the printing apparatus is composed. To cope with such variations in the printing characteristic, a calibration, in which for example a predetermined image processing parameter such as a gamma correction table is changed, has been known to be performed to make the printing characteristic predetermined one.

The calibration includes a processing causing the printing apparatus to print for example a chart arranging patches of a plurality of density levels to determine the printing characteristic of that apparatus. Then, the processing causes a reading apparatus such as a color measuring device to measure densities of patches and changes the contents of the image processing parameters such as the gamma correction table based on the measured density values of the patches.

In a printing apparatus of an ink jet method it is known to be observed that a solvent of ink such as water evaporates through ink ejection openings in a printing head to increase a viscosity of ink, though there is variation in degree of the increasing. This may result in ejection failures, such as ejected ink droplets decreasing in amount and deviating from an intended direction. Even when the ink is ejected normally, the evaporation of the ink solvent may increase a concentration of a coloring material of ink, such as dye or pigment, to a higher-than-normal level. Hence, when there are such ejection failures and increased dye densities at time of printing patches in the calibration, this means that the same ink ejection condition as the actual printing operation is not realized. The result of measurement of such printed patches therefore may not accurately represent the printing characteristic of the apparatus during the actual printing.

Generally, the ink jet printing apparatus, when the printing is not performed, covers a surface of the printing head provided with the ink ejection openings with a cap so as to restrain the ink solvent from evaporating to prevent an increase in the viscosity of ink. It is noted, however, that if the cap is constructed to seal the ejection opening-formed surface completely air-tight, a capping action of the cap to the printing head increases the pressure within the cap and destroys ink meniscuses formed near the ejection opening, leading to ink leakage and unstable ink ejection. For this reason, the cap is generally formed with a hole to communicate its interior with the open air or the capping is done in such a manner as to form a clearance. However, when the printing is not performed for a long period of time, the ink solvent vaporizes, though in small amounts, through the hole or the clearance. There is a correlation between the amount of ink solvent evaporated and the time that the apparatus is left unused. The increase in ink viscosity and in dye concentration due to the solvent evaporation proceeds from the ejection opening toward an interior of an ink passage as the time that the apparatus is left unoperated increases.

As the described above, the ink jet printing apparatus may have decreasing in the ink ejection volume and increasing in the coloring material concentration due to the evaporation of ink solvent, though there is variations in the degree of the decreasing or the increasing. When the degree of the reduction in the volume of ink ejected and the increase in the coloring material concentration are relatively small, the effect they have on the image printed by the normal printing operation cannot be recognized by naked eye. However, the chart printed during the calibration is measured for density as by a color measuring device or the like, so even when the ejection amount reduction and the coloring material concentration increase are relatively small, they are recognized in the measuring process as significant density differences or color differences. Therefore, the calibration data obtained from such a measurement does not precisely represent the printing characteristic of the apparatus. It is thus difficult to perform a precise calibration.

As a means for removing ink of increased viscosity and increased coloring material concentration, a so-called preliminary ejection is known which ejects a predetermined amount of ink at a predetermined location in the apparatus, for example, before starting the printing operation. Since the preliminary ejection in general is intended to remove those portions of ink at or near the ejection opening which have the increased viscosity and the increased concentration of coloring material, the amount of ink ejected during the preliminary ejection is small, and accordingly not enough to remove all the ink whose viscosity and coloring material concentration have increased relatively significantly over a long period of time during which the apparatus has been left unoperated.

As a means that can remove ink whose viscosity and coloring material concentration have increased to a significant extent, a recovery mechanism is known which discharges ink by drawing it by suction or pressurizing the interior of the printing head through the ink ejection openings. Hence, when printing a color chart for calibration, it is considered that this recovery mechanism can be activated to perform a recovery operation to ensure an accurate calibration.

However, when the calibration is carried out relatively frequently, the recovery operation is also performed similarly frequently to cause a problem associated with the waste ink discharged from the head. For example, in a printing apparatus which provides a reference for color calibration, because high precision in a color reproduction or a gradation level reproduction is required, the number of times that the calibration is performed increases. In that case, a disposal of the ink discharged as a result of the recovery operation for calibration raises an issue.

More specifically, the ink that is removed by the recovery mechanism by suction or pressurization is generally absorbed by a waste ink absorbent in the apparatus for natural drying. When the calibration is done frequently, the absorbent needs to have a sufficient capacity to absorb a greater amount of ink discharged by the recovery operations than can be dried naturally. This in turn increases the size of the apparatus.

When the apparatus is configured to discharge the ink into a container such as a waste ink tank, similar problems arise. That is, not only does the provision of a sufficient ink holding capacity increase the size of the apparatus, a separate new mechanism or new processing is required for processing the waste ink collected.

SUMMARY OF THE INVENTION

An object of the present invention is to provide an ink jet printing apparatus, a calibration method and a calibration chart printing method which can execute a highly precise calibration without processing for waste ink resulting from a recovery operation.

In the first aspect of the present invention, there is provided an ink jet printing apparatus, which uses a printing head for ejecting ink, ejecting the ink to a printing medium so as to perform printing, the apparatus comprising:

printing means that prints a chart for a calibration of the ink jet printing apparatus by causing the printing head to eject the ink to the printing medium, wherein the chart includes a patch to be measured by a measurement device and a pattern which is printed before the patch and is printed at an ejection duty equal to or higher than a maximum ejection duty in an ejection duty, at which the patch is printed.

In the second aspect of the present invention, there is provided an ink jet printing apparatus, which uses a printing head for ejecting ink, ejecting the ink to a printing medium so as to perform printing, the apparatus comprising:

printing means that prints a chart for a calibration of the ink jet printing apparatus by causing the printing head to eject the ink to the printing medium, wherein the chart includes a patch to be measured by a measurement device and a pattern which is printed before the patch and is printed at a predetermined ejection duty and as the pattern of a predetermined size.

In the third aspect of the present invention, there is provided a calibration method for calibrating an ink jet printing apparatus, which uses a printing head for ejecting ink, ejecting the ink to a printing medium so as to perform printing, the method comprising the steps of:

printing a chart for a calibration of the ink jet printing apparatus by causing the printing head to eject the ink to the printing medium;

executing a measurement of the chart by using a measurement device;

generating calibration data based on a result of the measurement; and changing predetermined data for printing, based on the generated calibration data, wherein the chart includes a patch to be measured by the measurement device and a pattern which is printed before the patch and is printed at an ejection duty equal to or higher than a maximum ejection duty in an ejection duty, at which the patch is printed.

In the fourth aspect of the present invention, there is provided a calibration method for calibrating an ink jet printing apparatus, which uses a printing head for ejecting ink, ejecting the ink to a printing medium so as to perform printing, the method comprising the steps of:

printing a chart for a calibration of the ink jet printing apparatus by causing the printing head to eject the ink to the printing medium;

executing a measurement of the chart by using a measurement device;

generating calibration data based on a result of the measurement; and changing predetermined data for printing, based on the generated calibration data, wherein the chart includes a patch to be measured by the measurement device and a pattern which is printed before the patch and is printed at a predetermined ejection duty and as the pattern of a predetermined size.

In the fifth aspect of the present invention, there is provided a method of printing a chart used for a calibration to calibrate an ink jet printing apparatus, which uses a printing head for ejecting ink, ejecting the ink to a printing medium so as to perform printing, the method comprising the step of:

printing the chart by causing the printing head to eject the ink to the printing medium, wherein the chart includes a patch to be measured by a measurement device and a pattern which is printed before the patch and is printed at an ejection duty equal to or higher than a maximum ejection duty in an ejection duty, at which the patch is printed.

In the sixth aspect of the present invention, there is provided a method of printing a chart used for a calibration to calibrate an ink jet printing apparatus, which uses a printing head for ejecting ink, ejecting the ink to a printing medium so as to perform printing, the method comprising the step of:

printing the chart by causing the printing head to eject the ink to the printing medium, wherein the chart includes a patch to be measured by a measurement device and a pattern which is printed before the patch and is printed at a predetermined ejection duty and as the pattern of a predetermined size.

With the configuration described above, a calibration chart is printed that includes patches to be measured by a measuring device and a pattern printed, prior to the printing of the patches, at an ejection duty equal to or higher than a maximum ejection duty of the patches. This chart printing allows the amount of ink ejected for printing the pattern of the chart from the printing head to be set larger than that of a normally executed preliminary ejection by properly determining the ejection duty and the shape (or size) of the pattern, and to be made just enough to remove the ink which has a relatively high viscosity and an increased coloring material concentration. This can prevent the patches to be measured from being printed with ink whose viscosity and coloring material concentration are higher than normal, and then the patches can be printed, which faithfully reflect the printing characteristic of the printing head or the like at time of printing.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described in detail below by referring to the accompanying drawings.

Figure 1:
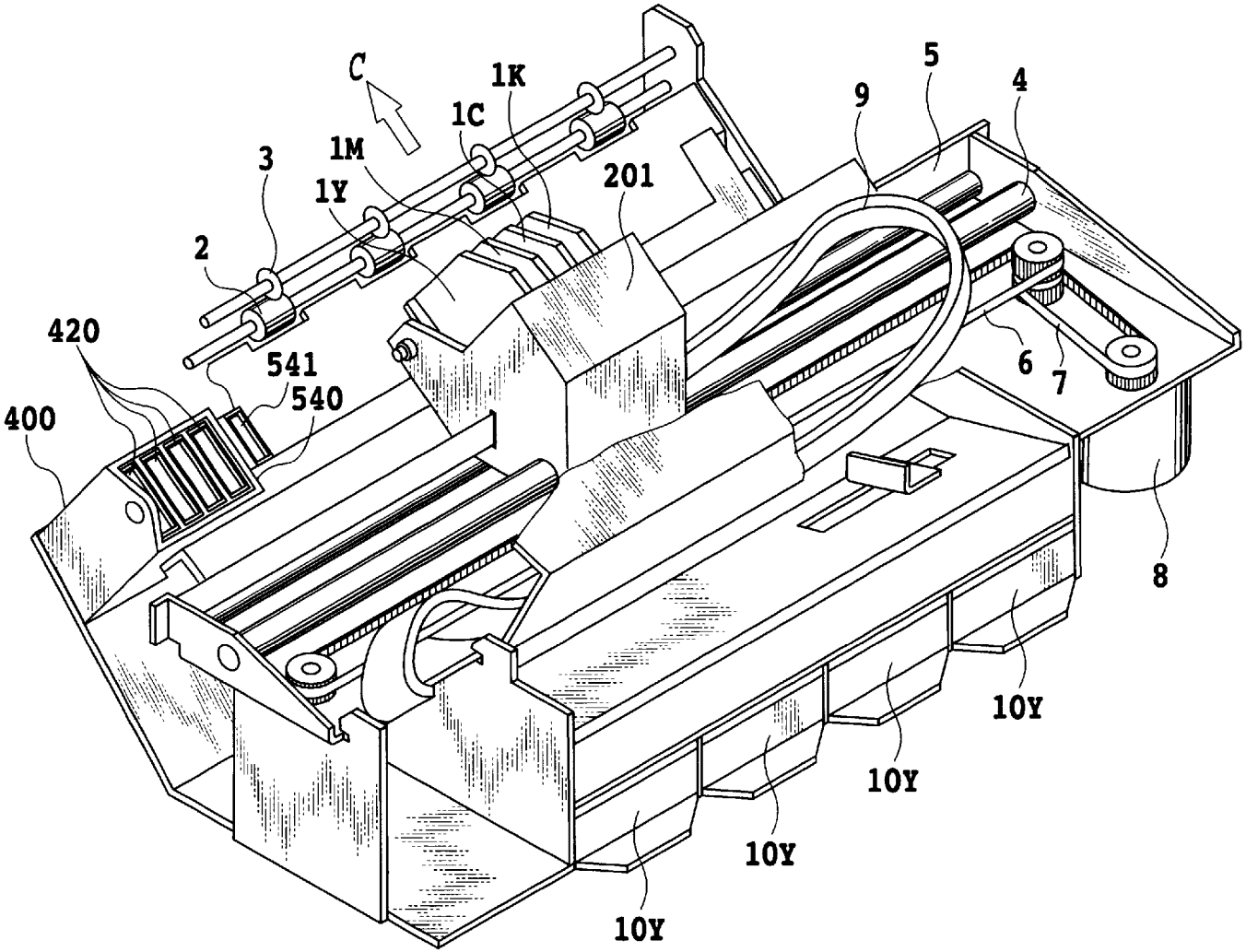
FIG. 1 is a perspective view showing a main part configuration of the ink jet printer according to one embodiment of the present invention.

One embodiment of the present invention relates to a so-called serial scan type ink jet color printer as an ink jet printing apparatus. FIG. 1 is a perspective view showing the configuration of a main portion of the printer.

In FIG. 1, a printing head 1Y for ejecting a yellow ink, a printing head 1M for a magenta ink, a printing head 1C for a cyan ink and a printing head 1K for ejecting a black ink are mounted at predetermined intervals on a carriage 201. Each of the printing heads has n ink ejection openings, for example 256 ejection openings, arrayed in a predetermined direction. In each inside of the ejection opening (ink passage) there is provided an electro-thermal transducer that generates thermal energy used for ejecting ink, as described later with reference to FIGS. 8A, 8B and 9. The thermal energy generated by the electro-thermal transducer produces a bubble in the ink to eject ink by pressure of the bubble. The carriage 201 is connected with an ink tube 9 through which inks from ink tanks 10Y, 10M, 10C and 10K storing the respective inks are supplied to the respective printing heads. The printing heads are each detachably mounted on the carriage 201. The ink tanks are also detachably mounted on the printing apparatus. This arrangement allows their replacement with new printing heads and ink tanks.

A printing medium (not shown), such as a paper and a thin plastic sheet, is held by both a pair of a transport roller and a pinch roller (neither of them shown) and a pair of discharge rollers 2, 3 to be fed in the direction of arrow C as the transport roller and the paper discharge roller 2 rotate by driving force. The carriage 201 is guided by a guide shaft 4 and the drive force of a carriage motor 8 is transmitted to the carriage 201 through drive belts 6, 7, causing the carriage 201 to reciprocally move along the guide shaft 4. This carriage movement allows the printing heads 1Y, 1M, 1C, 1K to be scanned over the printing medium, and during the scanning of the printing heads ink is ejected from each printing heads according to printing data to perform printing on the printing medium. In this printing, the electro-thermal transducers are driven according to timings at which an encoder 5, which is provided parallel to the guide shaft, detects the positions of scanned the printing heads, so as to eject black, cyan, magenta and yellow inks in that order for each pixel.

At the home position of the carriage 201, which is positioned outside the scan area of the printing heads, a recovery unit 400 is arranged, which includes a cap portion 420 having caps corresponding to the respective four printing heads. When a printing operation is not performed, the carriage 201 is moved to the home position and the caps of the cap portion 420 cover the ejection opening-formed surfaces of the respective printing heads to restrain evaporation of ink solvent. This can prevent an increased viscosity of ink due to evaporation of the ink solvent, a clogging of ejection openings with foreign matters such as dust adhering to the ejection opening-formed surface and an increased dye concentration of ink. The cap portion 420 is also used as an ejected ink receiver when the printing heads eject ink for performing a preliminary ejection. It is also used for the recovery operation in which, with the cap portion 420 putting the caps on the printing heads, a pump not shown is operated to draw ink from the ink ejection openings by suction. Further, at the position adjacent to the cap portion 420 are arranged a blade 540 and a wipe member 541, which clean the ejection opening-formed surfaces of the printing heads as the printing heads move.

The carriage 201 is connected with a flexible printed circuit board (not shown) so that control signals and ejection signals can be transferred between a control section of the printer and the printing heads.

Figure 2:
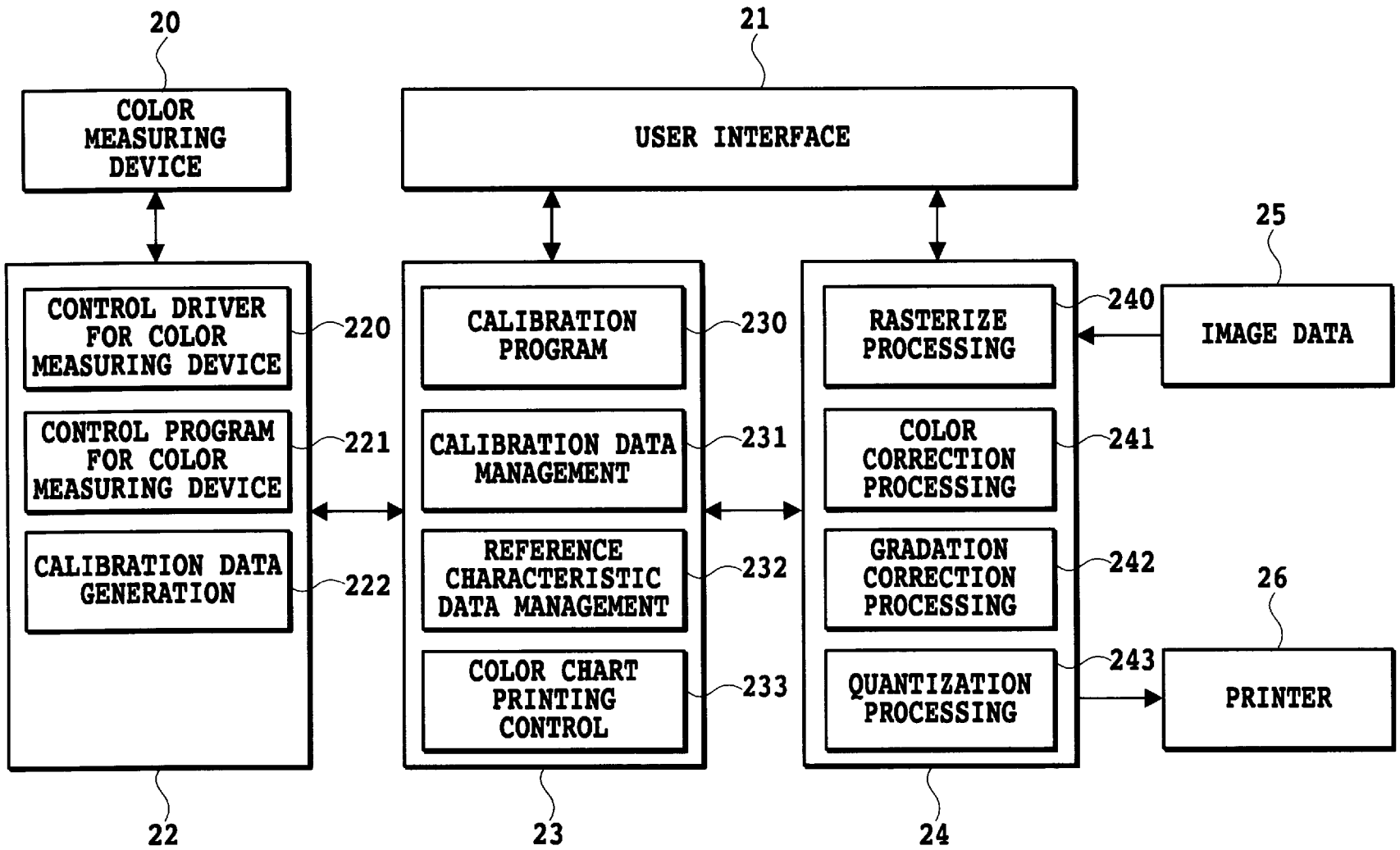
FIG. 2 is a block diagram showing a configuration of a printing system including the printer and having a calibration function therefor.

FIG. 2 is a block diagram showing a system configuration associated in particular with a calibration in a printing system using the printer of FIG. 1 as a printing apparatus.

The printing system of this embodiment is embodied by including the printer of FIG. 1 and a personal computer as a host device. The personal computer generates and sends printing data to the printer, and then the printer performs printing based on the printing data received. For calibration, a color measuring device is connected to the personal computer, which based on the densities of patches measured by the color measuring device, generates calibration data and updates a gradation correction parameter based on the calibration data. That is, the configuration shown in FIG. 2 embodied by including the printer 26, the color measuring device 20 and the personal computer (hereinafter also referred to as PC) having various functions.

In the PC, a calibration management section 23 in the form of software is based on a program 230 for controlling the calibration operation, and manages calibration data 231 and reference characteristic data 232 and executes a printing control 233 of a color chart.

The reference characteristic data refers to data which represents printing characteristic of the printing apparatus used as a reference, as described in connection with FIG. 3. The printing apparatus used as the reference may be a virtual apparatus with a predetermined printing characteristic or one apparatus, which is used the reference, of a plurality of printing apparatus connected for the printing system. Further, the reference characteristic data indicates the printing characteristic for each color in the case that the printing apparatus provides color representation with four colors, yellow, magenta, cyan and black, as in this embodiment.

Figure 3:
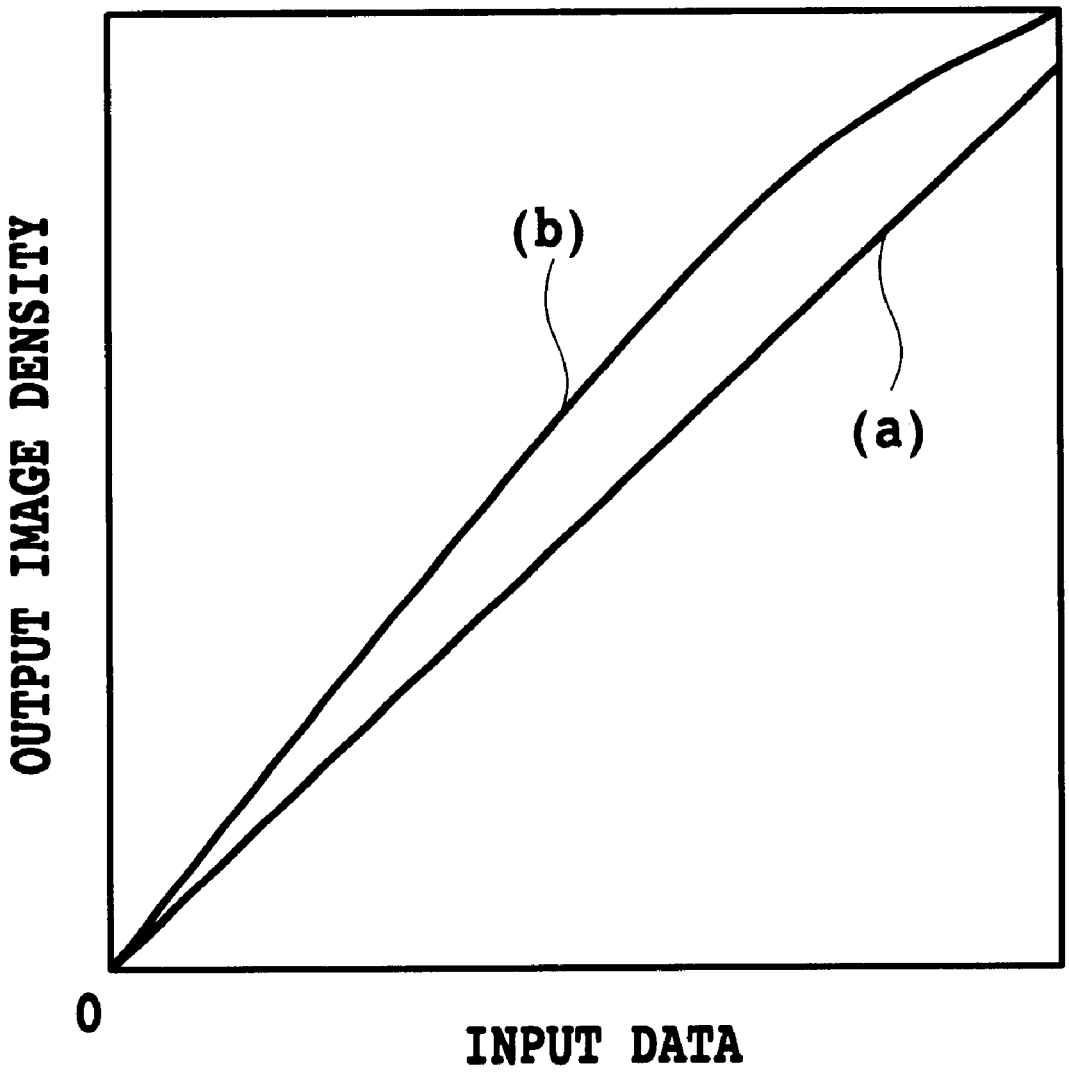
FIG. 3 is a diagram showing reference characteristic data and measured characteristic data obtained in the calibration for the printer.

A line (a) in FIG. 3 indicates one of the reference characteristic data which is represented as a relation between input image data and a density (optical density) of an output image. The calibration is performed to ensure that the calibrated printing apparatus has this printing characteristic and this characteristic is an aim printing characteristic in the calibration. That is, this printing characteristic is what a gradation correction processing 242 in an image processing 24 is intended to generate. As a result of this correction, a relation among gradation values of an image data can be realized as a relation among the density of printed image, and thus a linear gradation characteristic can be obtained. The relation represented by the line (a) is not limited to the linear relation described above. To realize a desired gradation characteristic of a printed image, the relation may also be non-linear depending on the characteristic of the reference printing apparatus or the characteristic property to be realized in the printed image.

The reference characteristic data management 232 holds the reference data in a predetermined memory in the form of a table for each color and outputs table data as required. In this embodiment, although the printing characteristic for input image data is represented as a density value, it may use a lightness value or an XYZ value in the XYZ color system of CIE.

The color chart printing control 233 in the calibration management unit 23, as described later, performs control of causing the printer 26 to print a chart including patch of each color.

Further, in FIG. 2 a color measurement management section 22 composed in the form of software in the PC controls the color measuring device 20 for measuring the density of the patches through a control driver 220 and a control program 221 for the color measuring device 20, and based on the measured value, controls a calibration data generation 222 for generating calibration data.

Similarly, an image processing section 24 composed in the form of software in the PC executes generation of printing data not only for printing of patches in the calibration process but also for normal printing operation. More specifically, when performing the normal printing operation, firstly a rasterize processing 240 is executed for image data 25 processed in this PC, which is the printing data written in a predetermined language, to produce printing data of bit image. Then, a color correction processing 241 and a gradation correction processing 242 are executed successively on the bit image. The gradation correction processing 242 has a table of relationship shown in FIG. 4 and corrects the gradation value of the printing data. More specifically, as described later, the content of the table is updated by the calibration, thus making the relation between the input image data (printing data) and the output image density equal to the characteristic of the reference printing apparatus. It is thereby possible to realize gradation representation faithful to the input image data.

With the processing described above completed, the image processing unit 24 performs a quantization processing 243 to generate binary data. The binary data is directly one for driving the printing heads of the printer 26 to eject ink.

Through a user interface 21, a user can make a variety of settings and enter commands for the calibration and the printing operation.

The calibration processing by the configuration of FIG. 2 will be explained with reference to a flow chart of FIG. 6.

First, the color chart printing control 233 prints a color chart for calibration in a printer to be calibrated (step S61).

Figure 5:
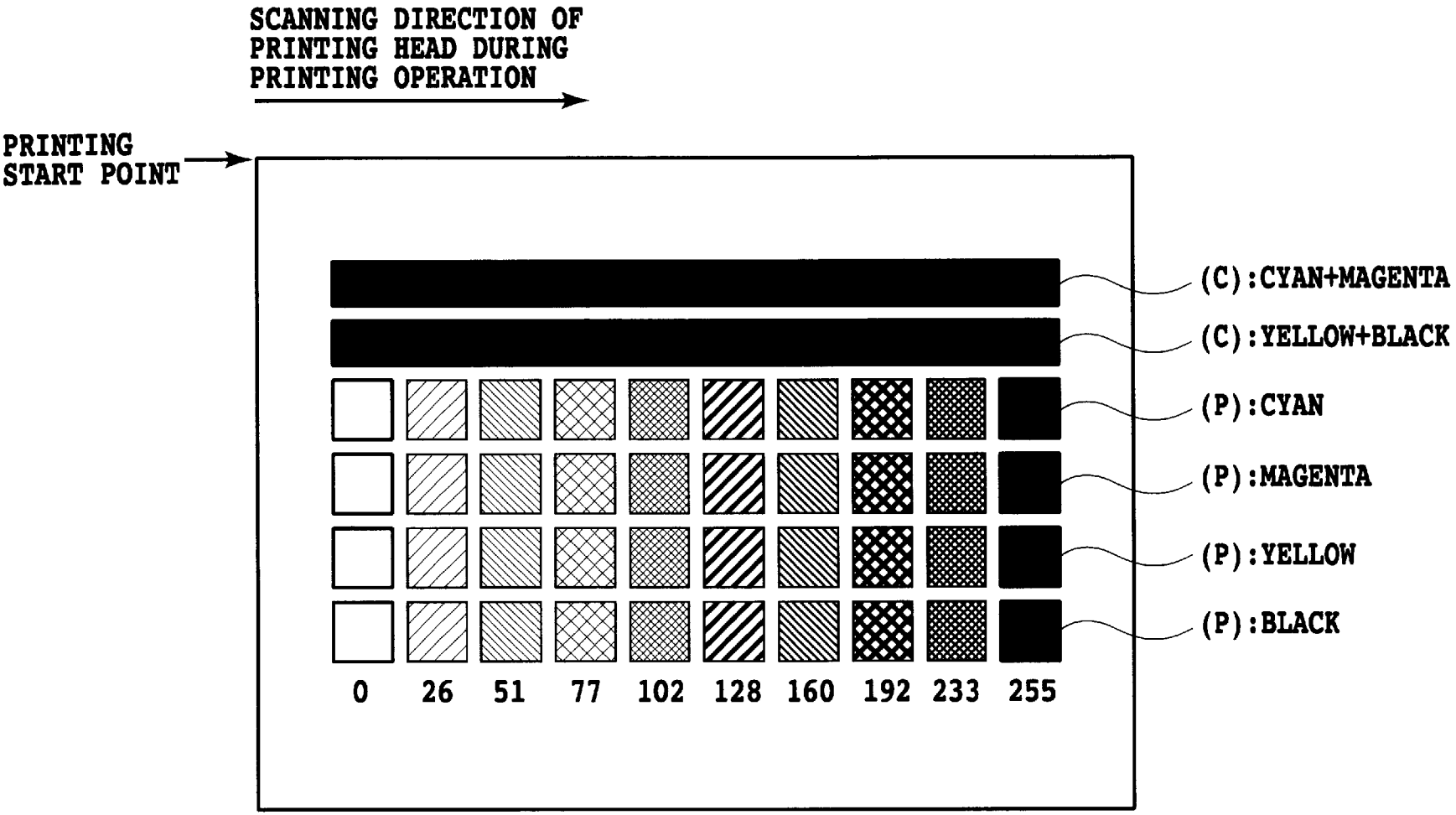
FIG. 5 is an illustration showing a color chart for calibration according to one embodiment of the invention.

More specifically, the image data of band patterns (c) and patches (p) of a chart shown in FIG. 5 is read from a predetermined memory and is subjected to the above-described processing by the image processing unit 24. Then, binary data is obtained and transferred to the printer 26 to cause the printer to print the chart based on the transferred printing data. In the image processing 24 for the image data of the patterns (c) and patches (p) in the calibration, the gradation correction processing 242 sets an uncorrected table that can output the input image data as is, in order to determine the printing characteristic of the printer at this time. It should be noted that in the processing for the image data of the patterns (c), because this data is not the one to be measured, the table used need not necessarily be such as the uncorrected one stated above.

Next, the patches (p) in the color chart printed by the printer 26 are measured for their density by the color measuring device 20. This measurement may be done, for example, by the user setting a sheet of paper printed with the above-described chart in the color measuring device 20. That is, for the set sheet, the control driver 220 in the color measurement management unit 22 executes the process to measure the density of each patch (p) printed on the sheet. At this time, the patterns (c) are not measured. The measured density data of each patch is stored in a predetermined memory by the processing of the color measuring device control program (step S62).

One example of the measured data is shown as a line (b) in FIG. 3. This line represents a relationship between the input image data and the output image density, as in the reference characteristic data described above. In other words, it represents a printing characteristic of the printer 26 at the time of the measurement. The measurement data is obtained for each color of ink used in the printer 26.

The calibration data generation 222 compares the measured data for each color with the reference characteristic data and generates calibration data (step S63).

Figure 4:
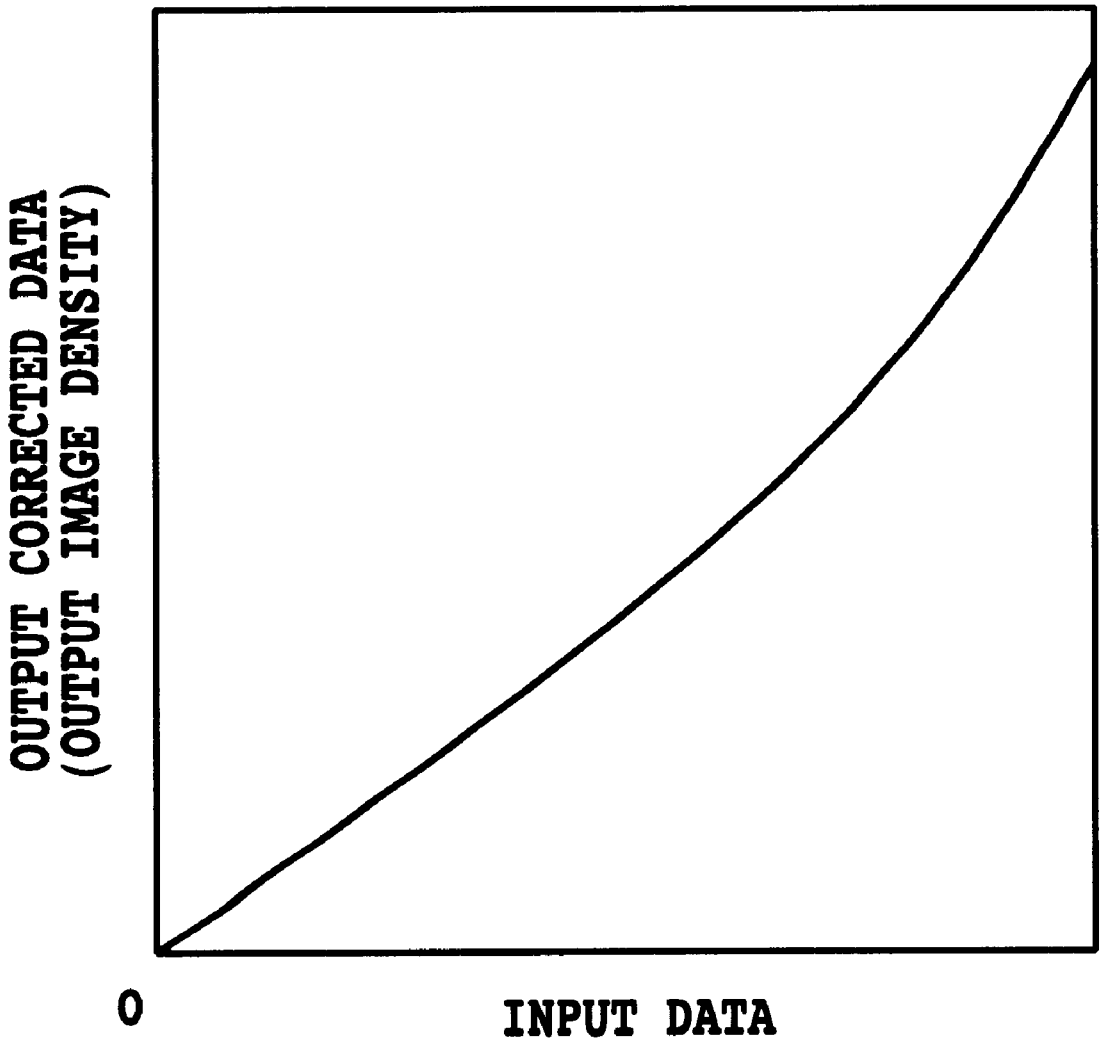
FIG. 4 is a diagram showing calibration data obtained based on the measured characteristic data.

More specifically, the calibration data is obtained in a manner that correction data composing the calibration data is generated based on a difference between the measured data and the out put image density of the reference characteristic data for the same input image data so as to correct the input image data so that the corrected input image data produces the output image density, which is equivalent to the output image density for the original (uncorrected) input image data in the reference characteristic data. FIG. 4 shows one example of generated calibration data. The gradation correction processing 242 executes the correction process using the data shown in FIG. 4, to cause the relationship between the input image data and the output image density to be made equal to the characteristic of the reference printing apparatus.

The calibration data thus obtained is set as a content of the table in the gradation correction processing 242 of the image processing section 24, as required at the printing operation for example, by the calibration data management 231 in the calibration management section 23 (step S64). Now the calibration is completed.

In the embodiment above, although individual processing and controls in the printing system including the calibration function have been described to be performed mainly by the PC, the application of the present invention is not limited to this example. For example, the controls and processing described above may also be performed on the printing apparatus side.

FIG. 5 is a diagram showing a color chart printed in the calibration processing described above.

As shown in the figure, the patches (p) to be measured for each of four colors: cyan, magenta, yellow and black correspond to gradation value data (image data) 0, 26, 51, 77, 102, 128, 160, 192, 223 and 255, in the case that the data is represented as 8-bit data. Performing printing based on these data can produce patches (p) at 10 different density levels for each color.

In addition to the patches (p) for each color, the band patterns (c) formed by mixtures of cyan and magenta and of yellow and black are printed prior to printing the patches. The gradation value data of each color ink to form the band pattern is set to 255.

More specifically, the patches (p) and the band patterns (c) are printed by scanning the printing heads in the scan direction indicated by the arrow, beginning with a start point shown at the upper part of the figure. Between the successive scans of the printing heads the paper is fed in an upward direction in the figure. Hence, the band pattern (c) of a mixture of cyan and magenta is printed first, followed by the band pattern (c) of a mixture of yellow and black. Then, patches (p) are printed in a line one at each of 10 density levels for each color, sequentially. Though sizes of the band pattern and the patch are basically determined below, they are set larger than predetermined sizes, considering the measuring precision of the color measuring device. Such sizes of the band patterns and the patches cannot be printed in one scanning of each printing head. Accordingly, a plurality of times of scanning is required for printing each band pattern and each patch.

In this embodiment, as described later in detail with reference to FIGS. 8A, 8B and 9, the size (largeness) of the band patterns (c) and their gradation values for printing them are determined by calculating, for each ejection opening of each printing head, a number of ink droplets to be ejected (number of ejection times) that is enough to discharge the ink whose viscosity and coloring material concentration increased and are determined as a size and a gradation value that can ensure the calculated number of ink droplets to be ejected.

In the printing of the band pattern (and the patches), the gradation value of 255 means that the printing heads are each driven at 100% duty. On the other hand, 100% duty means that one droplet of ink is ejected onto every one of pixels constituting the band pattern (and the patch). At this time, n ink ejection openings of each printing head are uniformly used for ink ejection in this embodiment. Thus, at 100% duty printing, every time when each of the ejection openings of the printing heads reaches a position of a pixel composing the band pattern during the scanning of the printing heads, one ink droplet is ejected from each ejection opening.

The band pattern has the gradation value 255 for each of the two component color inks, and therefor, the total duty is 200%. When the gradation value is 128 for each color, for example, the duty is 50% for each color. Although each of the band patterns has been described to be printed with a secondary color formed by two component colors, they may be printed with a tertiary or higher degree color depending on the determined number of ejection times described later. Data with less than 100% duty can be generated by known processing such as masking.

As described above, by printing the band pattern prior to printing the patches for the color-measurement and setting the density or duty of the band pattern equal to or higher than the maximum density or maximum duty of the patches, it is possible to eject a relatively large volume of ink in the printing of the band pattern. That is, the printing of the band pattern can eject a greater amount of ink than is ejected by the preliminary ejection. As a result, the ink whose viscosity and dye concentration increased due to evaporation of ink solvent can be discharged almost completely from the printing heads. This allows the patches of each color, which are printed thereafter, to be printed free of influences of a reduced ejected ink volume and an increased dye concentration resulting from the evaporation of ink solvent, so that the printed patches accurately reflect the printing characteristic of the printer at that time. This ensures highly precise calibration.

Further, since ink is ejected in the band pattern on the printing medium for dummy printing to remove viscosity-increased ink, a problem of waste ink as experienced with the recovery operation does not arise.

This embodiment offers a secondary advantage. When printing heads having electro-thermal transducers are used as in this embodiment, the temperatures of the printing heads are generally regulated. Since the patches for color measurement are printed after the temperatures of the printing heads have been stabilized by the dummy printing of the band pattern, the precision of calibration can further be enhanced.

Figure 7:
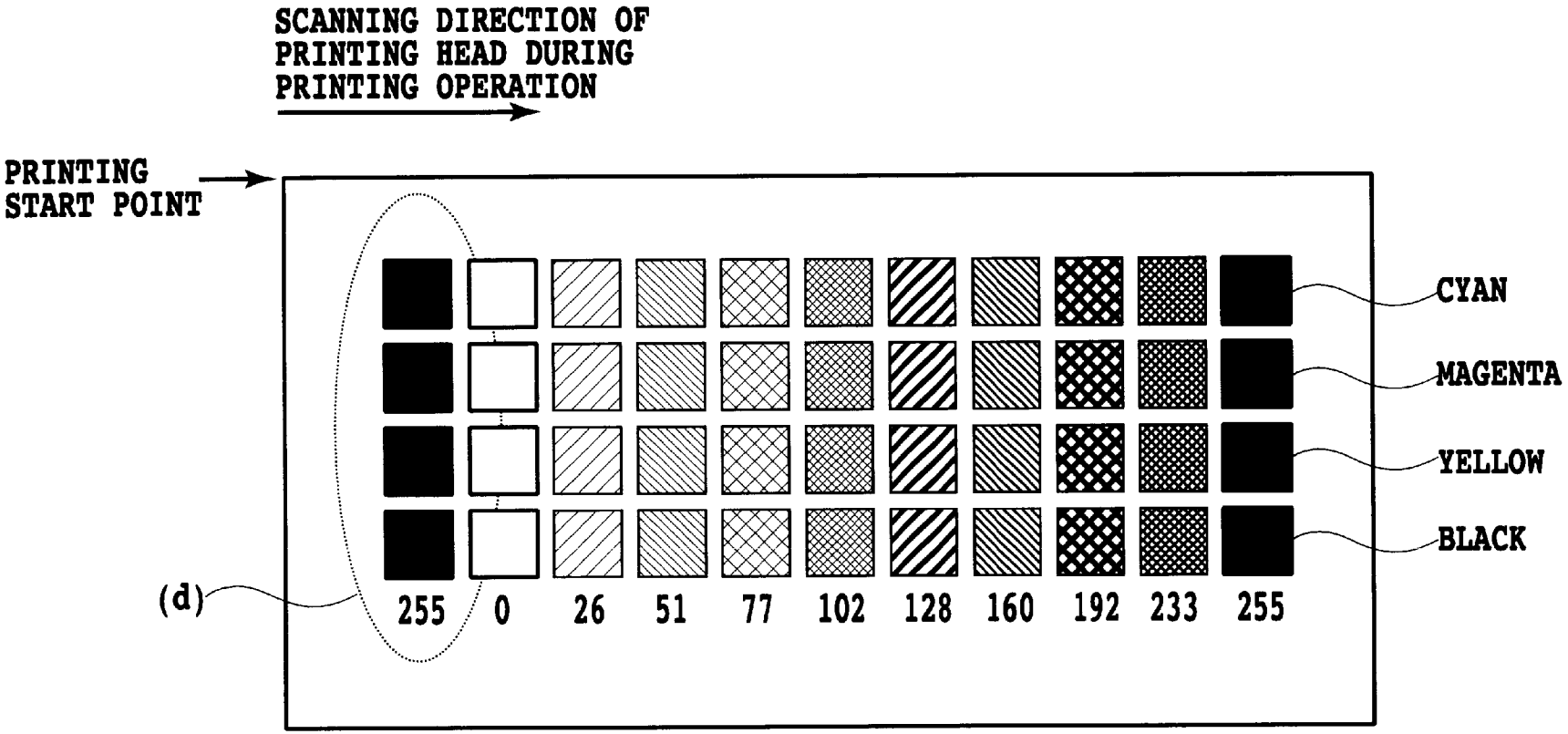
FIG. 7 is an illustration showing a color chart for calibration according to another embodiment of the invention.

FIG. 7 shows another embodiment of a color chart for the calibration.

As for the color measurement patches, the calibration color chart shown in the figure is similar to that shown in FIG. 5, except that dummy patches of the same size as the color measurement patches, shown at (d) in the figure, are printed one for each color. The sizes of the dummy patches are smaller than the band patterns shown in FIG. 5. That is, this embodiment represents an example case in which the printing head inherently has only a small amount of viscosity-increased ink or the amount of the viscosity-increased ink and the like to be discharged is set small, reducing the number of ink droplets (number of ejection times) required for each ejection opening to remove the highly viscous ink and the like from each ink ejection opening.

The dummy patches for respective colors, which are printed prior to the printing of the color measurement patches of corresponding color in the scanning of the printing head, have the gradation value of 255 each, which means the ink ejection duty is 100%. By performing the high duty ink ejection prior to the printing of the color measurement patches, it is possible, as in the case of FIG. 5, to discharge almost completely the ink affecting the calibration which has increased levels of viscosity and dye concentration, allowing a highly precise calibration.

Further, as in the example of FIG. 5, this embodiment has no problem with the disposal of waste ink and allows the color patches for color measurement to be printed after the temperatures of the printing heads are stabilized by the printing of the dummy patches.

Figure 8A:
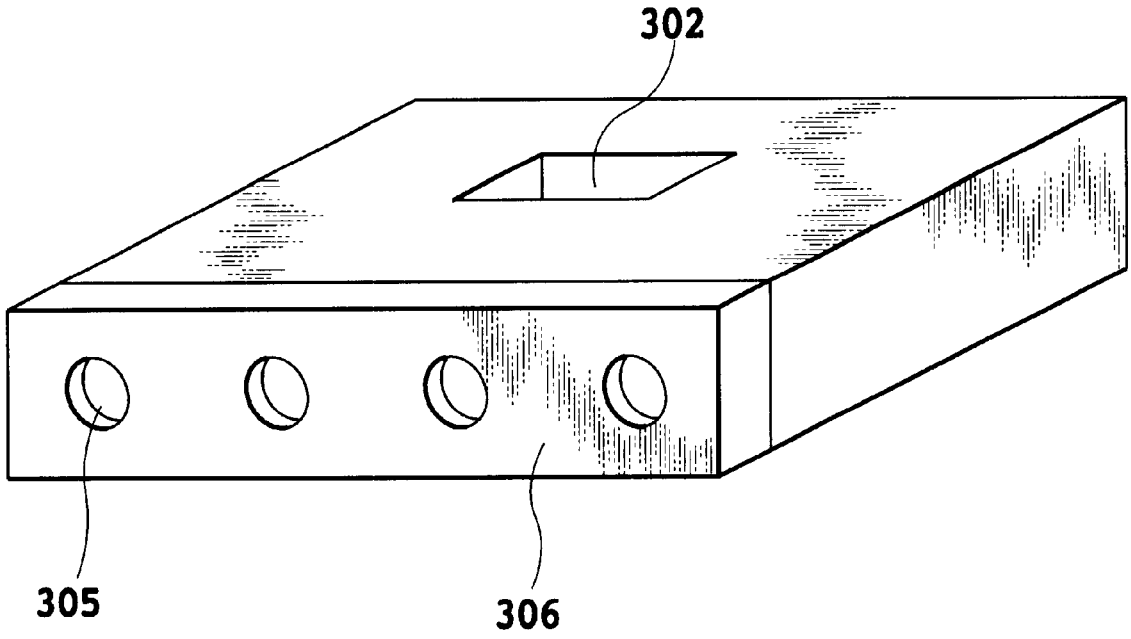
FIGS. 8A and 8B are a perspective view and an exploded perspective view respectively showing the details of the printing head shown in FIG. 1.
Figure 8B:
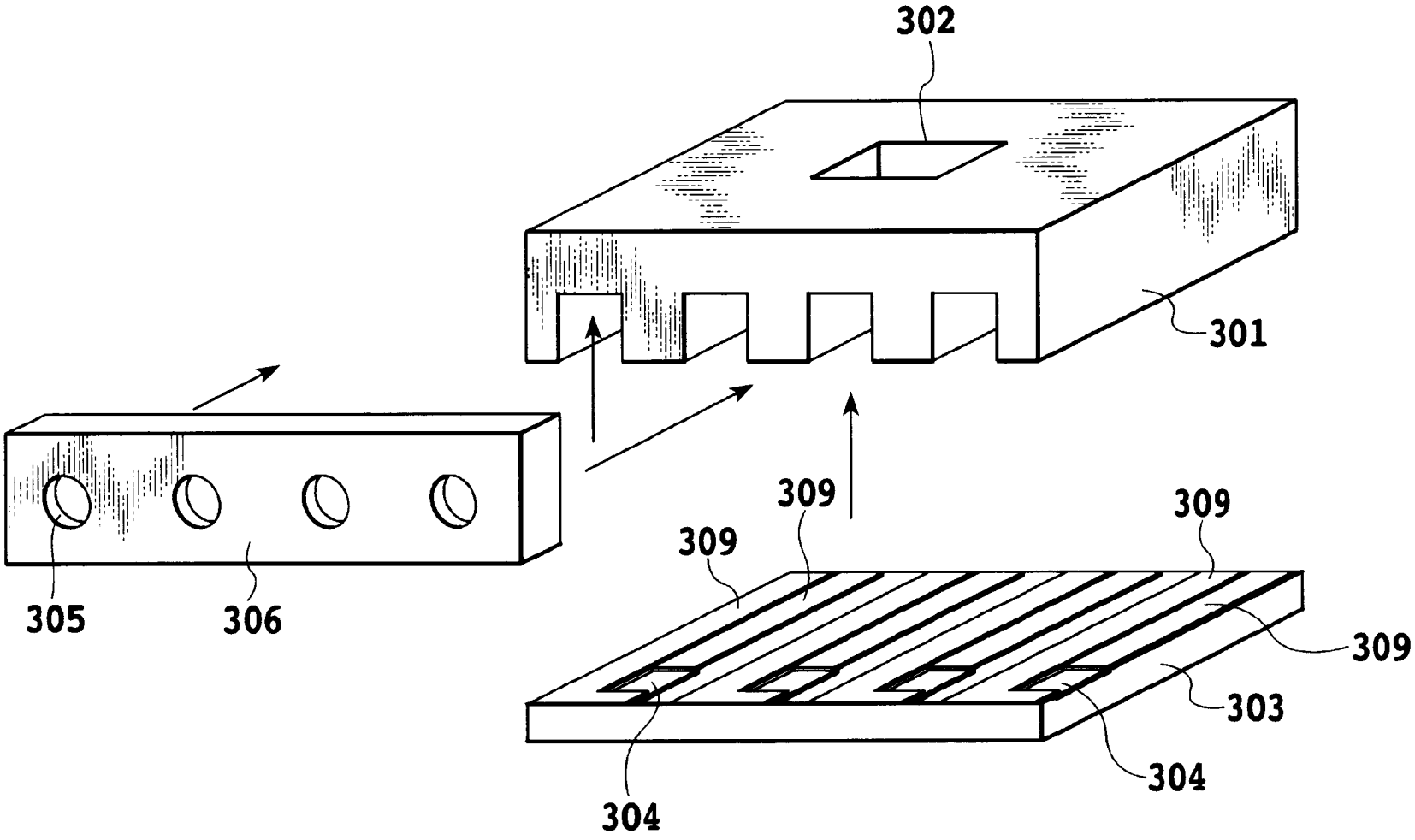
Figure 9:
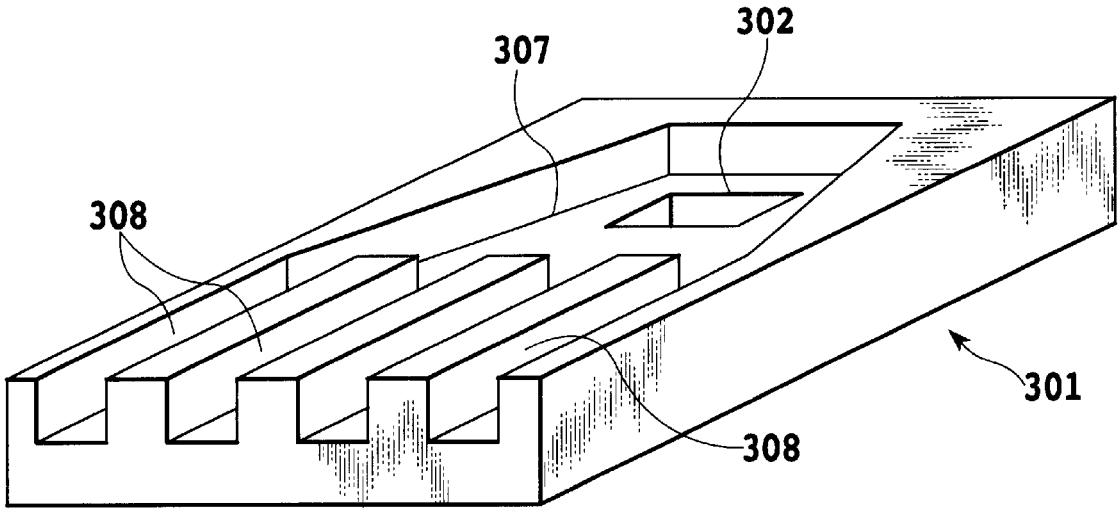
FIG. 9 is a perspective view showing a top plate of the printing head shown in FIGS. 8A and 8B.

FIGS. 8A, 8B and 9 illustrate the construction of the printing head that can be used in the preceding embodiments. By referring to these drawings, there will be described the method of determining the gradation value and the size of patterns, such as the band patterns (c) and the dummy patches (d) described in the preceding embodiments, that are printed prior to the printing of color measurement patches in order to discharge ink of viscosity-raised and the like.

As shown in FIGS. 8A and 8B, the printing head used in this embodiment constructed by having a heater board 303, a top plate 301 and an orifice plate 306. The heater board 303 is patterned with a resistance layer forming the electro-thermal transducers (heaters) 304, which are associated in one-to-one correspondence with the ink ejection openings, and electrode wires 309 for supplying electric signals to the heaters 304. At one end of the heater board 303 are provided a plurality of pads connected correspondingly with the heaters 304, which allow the electric signals from a printing apparatus body to be supplied to the heaters 304. The heaters 304 each generate thermal energy which in turn produces a bubble in ink, the pressure of which ejects the droplet of ink from the ink ejection opening 305. The heater board 303 combined with the top plate 301 and the orifice plate 306 formed with ejection openings constitutes a main portion of the printing head.

As shown in FIG. 9, the top plate 301 is formed with grooves 308 as ink passages leading to the corresponding ejection opening 305, and also with a groove 307 as an ink chamber that communicates commonly with the ink passages. The common ink chamber groove 307 is provided with an ink supply port 302 that is connected with a tube for supplying ink from an ink tank. Then the top plate 301 and the heater board 303, when joined together, form the ink passages corresponding to the ink ejection openings, with the heaters 304 arranged one in each ink passage. The ink ejection openings 305 formed in the plate 306 have a one-to-one relationship with the ink passages. The distances from the ink ejection openings to the heaters on the heater board are determined by the amount of ink ejected, the ink characteristics and the ejection performance dependent on the heater characteristic.

In the printing head with the above construction, the extent to which the ink viscosity and the coloring material concentration are increased generally depends on the structure of the printing head, on an environment in which the printing apparatus operates or the like. Hence, the ink ejection duty and the size of the pattern, such as band patterns (c) of FIG. 5 and the dummy patches (d) of FIG. 7 that are printed to discharge viscosity-increased ink and the like, can be determined according to a variety of conditions described above.

For example, it is desirable to ensure an ink ejection amount enough to remove all the ink present in the ink ejection openings, the ink passages and the common ink chamber in the printing head. When the ink is highly viscous not only around the ejection opening of the printing head but also in the common chamber, the above arrangement for ejection amount can not only expel the viscous ink but also allow the normal printing to be performed in a state completely free of the viscosity-increased ink.

In the case where the ink in a space ranging from the ejection openings to the common chamber is to be discharged, the process of determining the gradation value and the size of the band pattern or the dummy pattern that is printed prior to the printing of the calibration patches will be explained below.

When the volume of one ink ejection opening (product of an opening area of the ejection opening 305 and a thickness of the plate 306) is Vo, the volume of one ink passage is Vp, the volume of the common chamber is Vr and the volume of the common chamber divided by a number of ejection opening n is Vr/n, the number of times N that one ejection opening of the printing head needs to perform the ejection operation to discharge the ink occupying the space up to and including the common chamber (or number of ink ejection N) is given by $$N=(Vo+Vp+Vr/n)\div Vd$$

Where Vd is an amount of ink ejected from one ejection opening of the printing head at one time (volume of one ink droplet).

Based on the number of ink ejection N, the ejection duty and the size of the pattern shown in FIGS. 5 and 7 are determined. Suppose, for example, the ejection duty is set at 100% (the gradation value is 255). A number of pixels (actually a number of pixel intervals) that satisfies the following equation $$(\text{a number of ejection openings } n)\times(\text{the number of pixels})=N,$$

represents a length of the band pattern to be printed by one scanning of the printing head. Since the pattern is printed in a plurality of scans by transporting the paper actually, the length of the band pattern is obtained by dividing the above length of the number of pixels by the number of scans required to complete the pattern. In this way, by determining the number of ejection that each ejection opening performs to remove the viscosity-increased ink and the like and, based on the number of ejection, determining the ejection duty and the shape or size of the pattern, it is possible to effectively eliminate the viscosity-increased ink and the like that may affect the precision of the calibration. Further, as can be seen from above, the size of the pattern necessary for the ink elimination depends on the number of ejection openings of the printing head, printing resolution and duty for the pattern printing.

Another example of determining the number of ejection will be described as follows. When for example a recovery operation is performed before the calibration process, a method is available which considers the fact that the ink is discharged by the recovery operation.

That is, in the recovery operation which draws ink from the printing head by suction, when the amount of ink discharged by one ejection openings is taken as Vv, then the following equation can be set.

$$N=(Vo+Vp+Vr/n-Vv)\div Vd$$

The recovery operation may be done not only by suction but by applying pressure to the interior of the printing head. In the latter recovery operation using pressure application, the number of ejection can similarly be determined.

As still another example, it is possible to take into account a degree to which the ink viscosity may have been increased by elapsed time from the previous calibration and to change the number of ejection by using a time-dependent coefficient $\alpha$ corresponding to the elapsed time. That is, the following equation may be used for determine the number of ejection:

$$Nt=N\times\alpha$$

For example, the coefficient $\alpha$ may be set to 1 when the elapsed time is equal to or more than 24 hours. When the elapsed time t is less than 24 hours, the coefficient $\alpha$ may be determined by $$\alpha=t\div 24$$

(where t is expressed in hour; when the elapsed time is 30 minutes, t is 0.5). It is also possible to change this coefficient according to the property of ink such as ink solvent characteristic.

Since the above described patterns for dummy ejection is intended to remove the viscosity increased ink and the coloring material concentration increased ink from the printing head, the patterns may have any desired shape as long as it is printed prior to the printing of the color measurement patches. Although the patterns of a particular geometric figure, such as bands and patches shown in FIGS. 5 and 7, respectively, have been described to be printed for the dummy ejection, an instruction for explaining the calibration procedure may be printed to perform ejection for removing the viscous ink and the like before printing the color measurement patches.

Further, the pattern for dummy ejection may or may not be of the same shape as the color patches to be measured. It is also possible to arrange the pattern around the measurement color patches.

The dummy pattern may have whatever shape or arrangement as long as it can ensure the ejection of a sufficient amount of ink to eliminate the ink of increased viscosity or increased dye concentration.

Further, the present invention is not limited to the above embodiments. For example, the present invention can also be applied to a printing apparatus that uses more or fewer colors than four—yellow, magenta, cyan and black—by increasing or decreasing the number of colors used to print the calibration color chart. Furthermore, various other modifications and changes can be made without departing from the spirit of the invention.

<Other Embodiments>

As described above, the present invention is applicable either to a system comprising plural pieces of device (such as a host computer, interface device, a reader, and a printer, for example) or to an apparatus comprising one piece of device (for example, a copy machine or facsimile terminal device).

Additionally, an embodiment is also included in the category of the present invention, wherein program codes of software, which realize the above described embodiments, are supplied to a computer in an apparatus or a system connected to various devices to operate these devices so as to implement the functions of the above described embodiments, so that the various devices are operated in accordance with the programs stored in the computer (CPU or MPU) of the system or apparatus.

Figure 6:
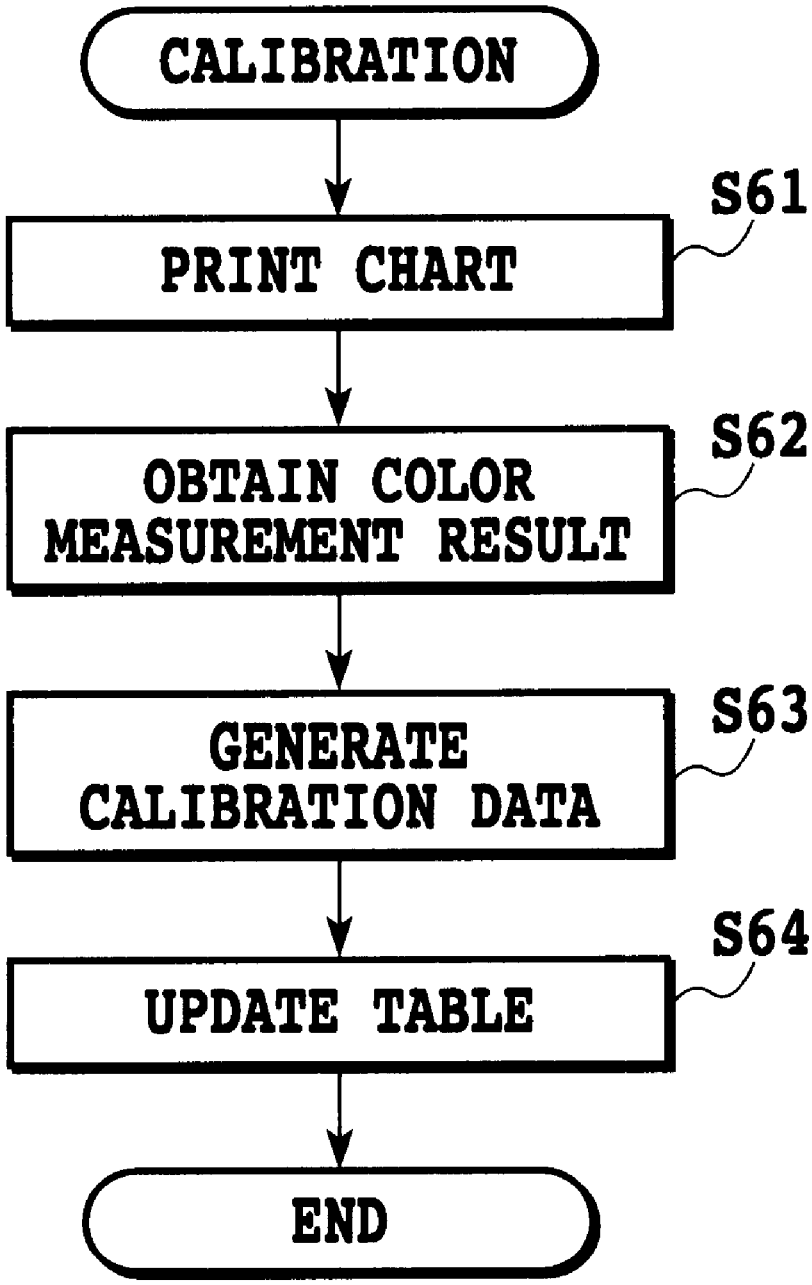
FIG. 6 is a flow chart showing calibration processing according to one embodiment of the invention.

In this case, the program codes of the software, such as those shown in FIG. 6, for example, themselves implement the functions of the above described embodiments, so that the program codes themselves and means for supplying them to the computer, for example, a storage medium storing such program codes constitute the present invention.

The storage medium storing such program codes may be, for example, a floppy disk, a hard disk, an optical disk, a magneto-optical disk, a CD-ROM, a magnetic tape, a non-volatile memory card, or a ROM.

In addition, if the functions of the above described embodiments are implemented not only by the computer by executing the supplied program codes but also through cooperation between the program codes and an OS (Operating System) running in the computer, another application software, or the like, then these program codes are of course embraced in the embodiments of the present invention.

Furthermore, a case is of course embraced in the present invention, where after the supplied program codes have been stored in a memory provided in an expanded board in the computer or an expanded unit connected to the computer, a CPU or the like provided in the expanded board or expanded unit executes part or all of the actual process based on instructions in the program codes, thereby implementing the functions of the above described embodiments.

As described above, according to the present invention, a calibration chart is printed that includes patches to be measured by a measuring device and a pattern printed, prior to the printing of the patches, at an ejection duty equal to or higher than a maximum ejection duty of the patches. This chart printing allows the amount of ink ejected for printing the pattern of the chart from the printing head to be set larger than that of a normally executed preliminary ejection by properly determining the ejection duty and the shape (or size) of the pattern, and to be made just enough to remove the ink which has a relatively high viscosity and an increased coloring material concentration. This can prevent the patches to be measured from being printed with ink whose viscosity and coloring material concentration are higher than normal, and then the patches can be printed, which faithfully reflect the printing characteristic of the printing head or the like at time of printing.

As a result, a highly precise calibration can be achieved without having to dispose of waste ink that would otherwise be produced by the recovery operation performed to remove undesirable viscous ink.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus, which uses a printing head for ejecting ink, ejecting the ink to a printing medium so as to perform printing, said apparatus comprising:

printing means that prints a chart for a calibration of said ink jet printing apparatus by causing the printing head to eject the ink to the printing medium, wherein the chart includes a patch to be measured by a measurement device and a pattern which is printed before said patch and is printed at an ejection duty equal to or higher than a maximum ejection duty in an ejection duty, at which said patch is printed.

2. An ink jet printing apparatus, which uses a printing head for ejecting ink, ejecting the ink to a printing medium so as to perform printing, said apparatus comprising:

printing means that prints a chart for a calibration of said ink jet printing apparatus by causing the printing head to eject the ink to the printing medium, wherein the chart includes a patch to be measured by a measurement device and a pattern which is printed before said patch and is printed at a predetermined ejection duty and as the pattern of a predetermined size.

3. An ink jet printing apparatus as claimed in claim 2, wherein the predetermined ejection duty and the predetermined size are determined based on a number of times of ejection required for discharging a predetermined amount of ink from the printing head.

4. An ink jet printing apparatus as claimed in claim 3, wherein the pattern has larger area than the patch.

5. An ink jet printing apparatus as claimed in claim 3, wherein the pattern has a same shape as the patch.

6. An ink jet printing apparatus as claimed in claim 3, wherein the pattern has a different shape from the patch.

7. An ink jet printing apparatus as claimed in claim 3, wherein the patch is printed with a primary color and the pattern is printed with a secondary color or higher degree color.

8. An ink jet printing apparatus as claimed in claim 3, wherein the printing head has an electro-thermal transducer to utilize the thermal energy generated by the electro-thermal transducer so that the ink is ejected.

9. A calibration method for calibrating an ink jet printing apparatus, which uses a printing head for ejecting ink, ejecting the ink to a printing medium so as to perform printing, said method comprising the steps of:

printing a chart for a calibration of said ink jet printing apparatus by causing the printing head to eject the ink to the printing medium;

executing a measurement of the chart by using a measurement device;

generating calibration data based on a result of the measurement; and changing predetermined data for printing, based on the generated calibration data, wherein the chart includes a patch to be measured by the measurement device and a pattern which is printed before said patch and is printed at an ejection duty equal to or higher than a maximum ejection duty in an ejection duty, at which said patch is printed.

10. A calibration method for calibrating an ink jet printing apparatus, which uses a printing head for ejecting ink, ejecting the ink to a printing medium so as to perform printing, said method comprising the steps of:

printing a chart for a calibration of said ink jet printing apparatus by causing the printing head to eject the ink to the printing medium;

executing a measurement of the chart by using a measurement device;

generating calibration data based on a result of the measurement; and changing predetermined data for printing, based on the generated calibration data, wherein the chart includes a patch to be measured by the measurement device and a pattern which is printed before said patch and is printed at a predetermined ejection duty and as the pattern of a predetermined size.

11. A calibration method as claimed in claim 10, wherein the predetermined ejection duty and the predetermined size are determined based on a number of times of ejection required for discharging a predetermined amount of ink from the printing head.

12. A calibration method as claimed in claim 11, wherein the pattern has larger area than the patch.

13. A calibration method as claimed in claim 11, wherein the pattern has a same shape as the patch.

14. A calibration method as claimed in claim 11, wherein the pattern has a different shape from the patch.

15. A calibration method as claimed in claim 11, wherein the patch is printed with a primary color and the pattern is printed with a secondary color or higher degree color.

16. A method of printing a chart used for a calibration to calibrate an ink jet printing apparatus, which uses a printing head for ejecting ink, ejecting the ink to a printing medium so as to perform printing, said method comprising the step of:

printing the chart by causing the printing head to eject the ink to the printing medium, wherein the chart includes a patch to be measured by a measurement device and a pattern which is printed before said patch and is printed at an ejection duty equal to or higher than a maximum ejection duty in an ejection duty, at which said patch is printed.

17. A method of printing a chart used for a calibration to calibrate an ink jet printing apparatus, which uses a printing head for ejecting ink, ejecting the ink to a printing medium so as to perform printing, said method comprising the step of:

printing the chart by causing the printing head to eject the ink to the printing medium, wherein the chart includes a patch to be measured by a measurement device and a pattern which is printed before said patch and is printed at a predetermined ejection duty and as the pattern of a predetermined size.

18. A method as claimed in claim 17, wherein the predetermined ejection duty and the predetermined size are determined based on a number of times of ejection required for discharging a predetermined amount of ink from the printing head.

19. A method as claimed in claim 18, wherein the pattern has larger area than the patch.

20. A method as claimed in claim 18, wherein the pattern has a same shape as the patch.

21. A method as claimed in claim 18, wherein the pattern has a different shape from the patch.

22. A method as claimed in claim 18, wherein the patch is printed with a primary color and the pattern is printed with a secondary color or higher degree color.

23. A program of processing for printing a chart used for a calibration to calibrate an ink jet printing apparatus, which uses a printing head for ejecting ink, ejecting the ink to a printing medium so as to perform printing, said processing comprising the step of:

printing the chart by causing the printing head to eject the ink to the printing medium, wherein the chart includes a patch to be measured by a measurement device and a pattern which is printed before said patch and is printed at an ejection duty equal to or higher than a maximum ejection duty in an ejection duty, at which said patch is printed.

24. A program of processing for printing a chart used for a calibration for calibrating an ink jet printing apparatus, which uses a printing head for ejecting ink, ejecting the ink to a printing medium so as to perform printing, said processing comprising the step of:

printing the chart by causing the printing head to eject the ink to the printing medium, wherein the chart includes a patch to be measured by a measurement device and a pattern which is printed before said patch and is printed at a predetermined ejection duty and as the pattern of a predetermined size.

25. A storage medium storing a program of processing, which is readable by a computer, for printing a chart used for a calibration to calibrate an ink jet printing apparatus, which uses a printing head for ejecting ink, ejecting the ink to a printing medium so as to perform printing, said processing comprising the step of:

printing the chart by causing the printing head to eject the ink to the printing medium, wherein the chart includes a patch to be measured by a measurement device and a pattern which is printed before said patch and is printed at an ejection duty equal to or higher than a maximum ejection duty in an ejection duty, at which said patch is printed.

26. A storage medium storing a program of processing, which is readable by a computer, for printing a chart used for a calibration for calibrating an ink jet printing apparatus, which uses a printing head for ejecting ink, ejecting the ink to a printing medium so as to perform printing, said processing comprising the step of:

printing the chart by causing the printing head to eject the ink to the printing medium, wherein the chart includes a patch to be measured by a measurement device and a pattern which is printed before said patch and is printed at a predetermined ejection duty and as the pattern of a predetermined size.

* * * * *